United States Patent [19]

Pearson

[11] 4,424,916

[45] Jan. 10, 1984

[54] TOOTHPASTE DISPENSER

[76] Inventor: Donald L. Pearson, 2449 Candlewick, Pontiac, Mich. 48055

[21] Appl. No.: 272,768

[22] Filed: Jun. 11, 1981

[51] Int. Cl.[3] ..... B65D 35/28

[52] U.S. Cl. ..... 222/74; 222/93; 222/94; 222/105

[58] Field of Search ..... 222/74, 82, 93, 94, 222/105, 153, 183, 207, 321, 325, 340, 380, 383, 384, 534, 538, 402, 387

[56] References Cited

U.S. PATENT DOCUMENTS

| | | | |
|---|---|---|---|
| 2,069,018 | 1/1937 | Rayburn | 222/93 |
| 2,536,277 | 1/1951 | Grieme | 222/384 X |
| 2,792,856 | 5/1957 | Coppage | 222/380 X |
| 3,035,737 | 5/1962 | Speas | 222/82 |
| 3,241,721 | 3/1966 | Freeman | 222/93 |
| 3,847,304 | 11/1974 | Cohen | 222/387 X |

*Primary Examiner*—F. J. Bartuska

*Attorney, Agent, or Firm*—Fisher, Gerhardt, Crampton & Groh

[57] ABSTRACT

An improved apparatus for dispensing toothpaste onto a toothbrush wherein a housing is adapted to be supported on a horizontal surface and provided with an opened bottom end so as to give access to a manually-operated reciprocating pump and a toothpaste container disposed in a side-by-side relationship within the housing. The toothpaste container has a collapsible inner lining containing the toothpaste and rigid outer casing. A conduit connects the outlet of the toothpaste container with the inlet of the manually operated pump. The pump has a discharge spout that is pivotally supported by the housing for horizontal movement, with complementary lock portions on both the spout and the actuating member of the pump so that the pump cannot be operated when the discharge spout is pivoted to a closed position.

5 Claims, 4 Drawing Figures

TOOTHPASTE DISPENSER

This invention relates to a toothpaste dispenser. More particularly, it relates to an improved, portable, self-contained apparatus for dispensing toothpaste onto a toothbrush which can be easily and efficiently operated from any horizontal surface, such as a table or countertop. It is particularly useful as a dental hygiene kit for travelers or apartment dwellers.

Various types of manually-operated dispensers for toothpaste, heavy creams, soap and the like have been found in the prior art. These devices were designed to be mounted on walls or the like, and in the case of the toothpaste dispensers, used commercial toothpaste tubes as sources for the toothpaste.

The disadvantages of these devices were that they required a permanent mounting and were inefficient in operation. They are useless for travelers or for those living in temporary residences, such as apartments or hotels. The finger operated pumps do not produce sufficient vacuum to remove all of the contents of the toothpaste tubes, thereby producing waste. In addition, the very nature of a commercial toothpaste tube prevents complete evacuation of its contents.

It is an object of this invention to provide an apparatus for dispensing toothpaste without the use of commercial toothpaste tubes.

It is another object of this invention to provide an apparatus for dispensing toothpaste that can be easily and efficiently operated from any horizontal surface.

It is another object of this invention to provide an apparatus for dispensing toothpaste that can be easily transported from site to site.

It is a further object of this invention to provide a portable, self-contained dental hygiene kit for efficient dispensing of toothpaste and storage for toothbrushes.

It is a further object of this invention to provide an apparatus for dispensing toothpaste in which the toothpaste is completely used.

It is still another object of this invention to provide an apparatus for dispensing toothpaste in which the discharge spout can be pivoted to a closed position locking the pump so as to prevent accidental discharge of the pump's contents.

It is a further object of this invention to provide an apparatus for dispensing toothpaste which is sanitary and tightly closed so that the contents do not dry out.

It is yet another object of this invention to provide an apparatus for dispensing toothpaste whereby the toothpaste tube can be easily replaced.

The objects of the invention are accomplished by providing an apparatus in which a manually-operated reciprocating pump is disposed in a side-by-side relationship with a toothpaste container, said toothpaste container consisting of a collapsible inner lining containing toothpaste and a rigid outer casing. The housing enclosing the pump and toothpaste container is adapted to be supported on a horizontal surface and provided with an open bottom end so as to give access to the pump and toothpaste container. A conduit connects the outlet of the toothpaste container with the inlet of the pump. The pump has a discharge spout that is pivotally supported by the housing for horizontal movement, with complementary lock portions on both the spout and the actuating member of the pump so that the pump cannot be operated when the discharge spout is pivoted to a closed position.

These and other objects of the invention will be apparent in the following description and from the drawings in which.

Figure 1:
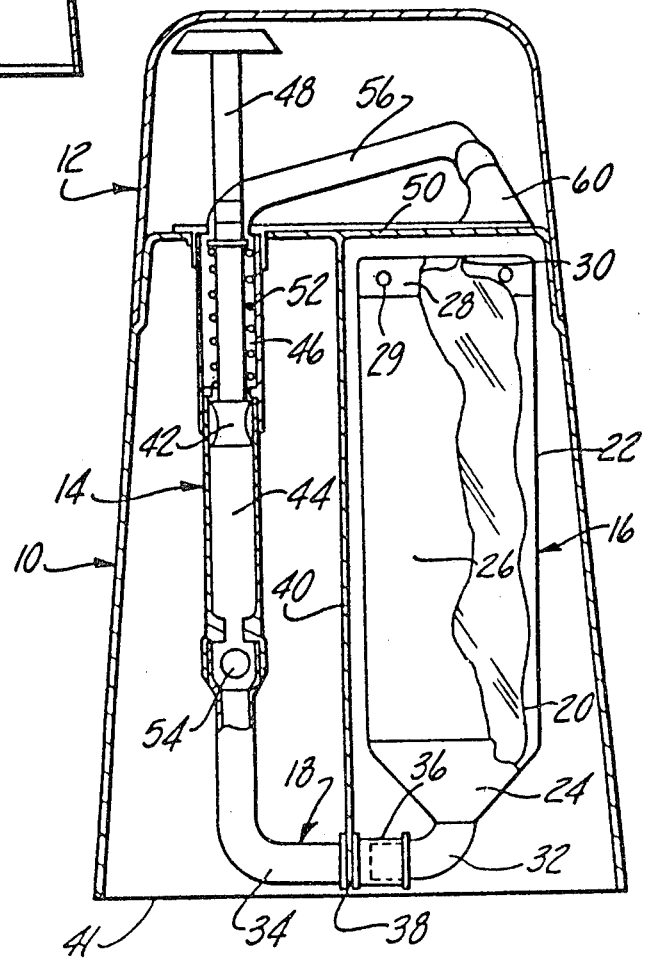
FIG. 1 is a sectional view of the preferred embodiment of the invention in a storage position and showing the relative positions of the pump, conduit, toothpaste tube and the lining of the toothpaste tube.

Referring first to FIG. 1, one embodiment of the invention shows the components of the apparatus mounted in a housing 10 with a dust cover 12 in place. In this storage position, the invention is shown as being both functional and esthetically pleasing in design.

A pump 14 is connected and communicates with a supply reservoir or toothpaste container 16, disposed in an inverted vertical position within the housing 10 by means of a U-shaped conduit 18. The toothpaste container 16 has an inner collapsible lining or bladder 20, preferably of polyethylene, enclosed by a rigid outer casing 22. Preferably, the casing 22 consists of a conical end piece 24 with an outlet at its apex, a cylindrical sleeve 26 and a closure cap 28. The edges of the lower end of the lining 20 may be sealed to the interior surface of the conical end piece 24. During commercial preparation, the collapsible lining 20 is filled with a semi-fluid toothpaste until the lining reaches its expansion limits as defined by the outer casing 22. The upper end 30 of the lining is then fused together and the closure cap 28 is snapped in place. The closure cap forming the end of the casing 22 may have breathing holes 29 to prevent to offset the production of a vacuum within the container 16 when the toothpaste is withdrawn.

As shown in the drawings, the conduit 18 can be defined by an arcuate section of tubing 32, serving as the outlet for toothpaste container 16, joined to and communicating with the arcuate inlet passage 34 of pump 14 by a grooved collar 36. Preferably, the groove 38 of the collar 36 is fittingly engaged with the distal end of the middle partition wall 40, so as to secure the toothpaste tube in an inverted vertical position. This arrangement allows an empty toothpaste container to be easily and quickly replaced by a full toothpaste container. The housing 10 may be provided with an open bottom end 41 to give easy access to both pump and toothpaste tube.

Figure 2:
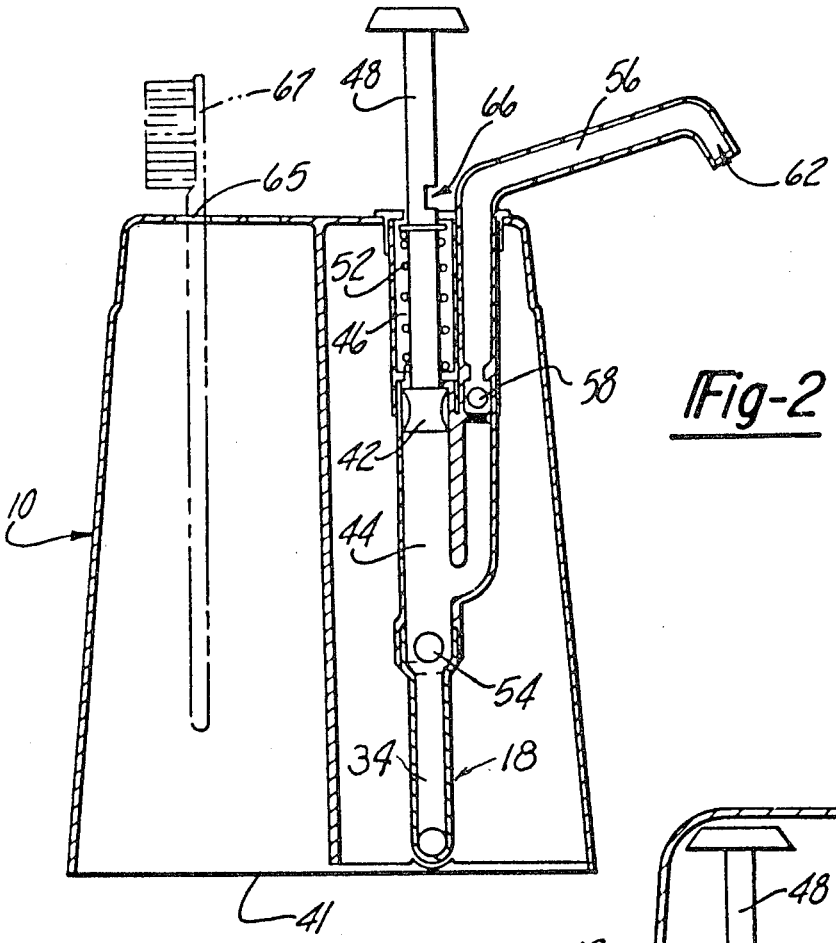
FIG. 2 is a sectional view of the apparatus in FIG. 1 in a dispensing position.

As shown in FIGS. 1 and 2, the preferred embodiment of the pump 14 is a manually operated reciprocating pump, although it is conceivable that other types of pumps can be used.

The pump 14 has a piston 42 mounted for reciprocation in a vertical cylinder, the cylinder being divided into an inlet passage 34, a feed chamber 44 and a bias chamber 46. A T-shaped depressible actuator 48 is connected to piston 42 and extends through the bias chamber 46 above and perpendicular to the top end 50 of housing 10. The bias chamber 46 has a spring means 52 which, following its compression during the downward or feed stroke of the actuator 48, returns the actuator and piston 42 upwardly under the action of spring 52 to their original positions. A one-way inlet valve 54 separates the inlet passage 34 from the feed chamber 44.

The apparatus provides for a discharge spout 56 that extends through the top end 50 of housing 10 and communicates with the feed chamber 44 of pump 14. The discharge spout 56 is pivotally supported for horizontal movement by housing 10 and has a one-way outlet valve 58 that separates the discharge spout from the feed chamber 44.

In operation, a fresh toothpaste container 16 is placed in the housing 10 and the end of the outlet tube 32 is inserted into the collar 36 securing the toothpaste container 16 to the pump 14. Following pressing of the plunger 48 downwardly and return reciprocating action of the piston 42, a vacuum is created wherein the toothpaste is drawn from the inner collapsible lining 20 of the toothpaste container 16 through the conduit 18, the inlet valve 54, and into the feed chamber 44 of the pump 14. As the toothpaste is withdrawn from the toothpaste container, the inner lining collapses upon the remaining toothpaste thereby eliminating air pockets and waste.

An additional downward or feed stroke of the T-shaped actuator 48 closes the inlet valve 54 and propels the toothpaste through the outlet valve 58, out the discharge spout 56, and onto the users toothbrush. The amount of toothpaste delivered to the user's toothbrush is governed by the frequency and length of the strokes.

Figure 3:
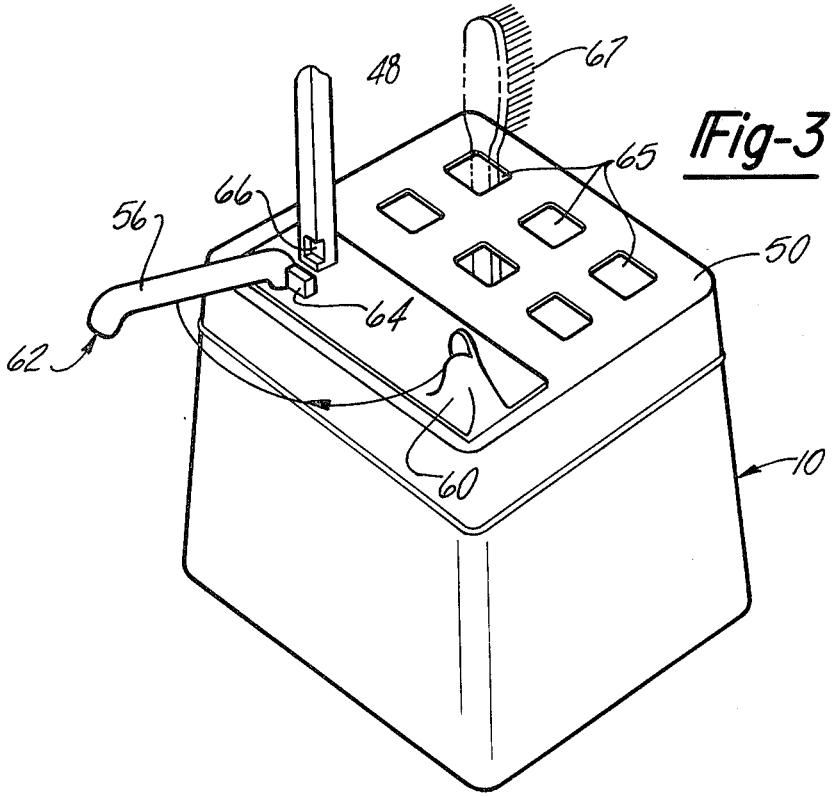
FIG. 3 is a top perspective view of the apparatus showing the complementary lock portions on the discharge spout and pump.

FIG. 3 illustrates a locking mechanism which is designed to prevent accidental discharge of toothpaste from the pump and prevent drying of the contents in the spout and pump.

After the toothpaste dispenser has been used and is ready to be stored away, the discharge spout 56 is pivoted from an open, dispensing position to a closed, storage position. A stop member 60 projects from the top end 50 of the housing 10 and is placed so as to receive the outlet end 62 of the discharge spout 56 when the spout is in a closed position closing the end 62, preventing the paste remaining in the spout 56 from drying out. The stop member is designed so that the outlet end of the discharge spout can be snapped on and off of it with a minimum of pressure. Simultaneously, a detent 64, located on the proximal end of the discharge spout 56, engages a notch 66 in the actuator 48, thus preventing reciprocation of the pump. FIG. 1 shows the discharge spout in the closed position.

FIGS. 2 and 3 also show the openings 65 in the top end 50 of the housing 10 for the storage of toothbrushes 67.

Figure 4:
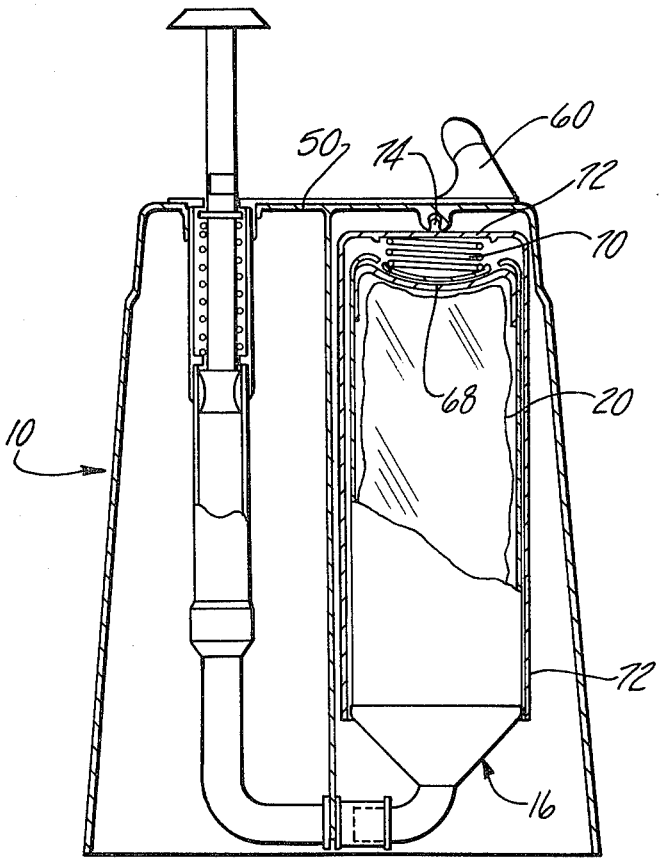
FIG. 4 is a cross section showing another embodiment of the invention.

An alternative design for the toothpaste container 16 is illustrated in FIG. 4. Instead of having a closure cap 28 at the upper end of the toothpaste container 16, this embodiment of the invention provides a spring biased piston or sliding member 68 at the upper end of the toothpaste container 16. The spring 70 is supported by a toothpaste container sheath 72 which encloses the toothpaste container 16. This sheath 72 is in turn vertically suspended from the top end 50 of the housing 10 by a suspension means in the form of a knob releasably fastened to a cup-like receptacle which allows a pivoting action permitting the tube 16 to be inserted into collar 36.

In operation, as the toothpaste is withdrawn from the inner collapsible lining 20, the piston or sliding member 68 is urged downward against the lining 20 by the spring 70, thereby aiding in complete evacuation of the contents of the toothpaste container.

Preferably, the major components of the apparatus, the pump, toothpaste container, housing and discharge spout, are constructed from hard plastic or the like. The lining 20 may be of a polyethylene-like material.

From the foregoing description, it can be seen that an improved portable toothpaste dispenser has been provided wherein a reciprocating pump is disposed in a side-by-side relationship with a toothpaste container, said toothpaste container having a collapsible inner lining or bladder and a plastic outer casing. A housing enclosing the pump and toothpaste container is adapted to be supported on a horizontal surface. A U-shaped conduit connects the outlet of the toothpaste container with the pump inlet. The pump has a discharge spout that is pivotally supported by the housing for horizontal movement, with complementary lock portions on both the spout and pump. A stop member is provided on the housing to seal or close the discharge spout outlet when in a storage position. The apparatus is designed to function as a portable hygiene kit with a storage area for toothbrushes.

The embodiments of the invention in which an exclusive property or pirvilege is claimed are defined as follows:

1. An apparatus for dispensing toothpaste onto a toothbrush comprising: a housing adapted to be supported on a horizontal surface and having an open bottom end giving access to the contents therein and a closed top end, an elongated toothpaste container removably disposed vertically in said housing and having a rigid outer casing and a collapsible inner lining containing toothpaste with an outlet at its lower end, breathing holes in said casing to prevent formation of a vacuum within the casing upon collapse of said lining upon removal of toothpaste from said outlet, a reciprocating pump disposed vertically in said housing in side by side relationship with said toothpaste container, said pump having an inlet at its lower end, a conduit communicating said inlet and said outlet below the level of said toothpaste container and said pump, a vertically stationary discharge spout communicating with said pump and being disposed above the level of said pump and container, said spout being pivotal horizontally between discharge and storage positions, said pump being actuated for removal of toothpaste from said lining and delivery of toothpaste through said discharge spout.

2. The apparatus of claim 1 and further comprising means on said housing closing the end of said discharge spout when the latter is in said storage position.

3. The apparatus of claim 1 wherein said pump has an actuating member movable downwardly from an upper position against the action of a spring and movable upwardly to said upper position by said spring, complementary lock portions on said spout and said actuating member engageable with each other when said nozzle is in said storage position and said actuating member is in said upper position to prevent reciprocation of said actuating member.

4. An apparatus for dispensing toothpaste according to claim 1 wherein said housing has a multiplicity of openings in said top end for holding and storing toothbrushes.

5. An apparatus for dispensing toothpaste according to claim 3 wherein said complementary lock portions on said spout and said actuating member of said pump includes a detent and notch, respectively.

* * * * *